US009312610B2

(12) United States Patent
Willner et al.

(10) Patent No.: US 9,312,610 B2
(45) Date of Patent: Apr. 12, 2016

(54) STEPPED SPRING CONTACT

(71) Applicant: Sensata Technologies, Inc., Attleboro, MA (US)

(72) Inventors: Andrew Willner, Attleboro, MA (US); Giovanni Fraone, Manfield, MA (US); Dedde Hedzer Wiersma, Deventer (NL); Andrew LeGendre, Dedham, MA (US); Raymond E. Mandeville, Cumberland, RI (US); Shuo Robert Chen, Providence, RI (US); Ted Medeiros, North Smithfield, RI (US); Matt Nelson, Watertown, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 14/467,869

(22) Filed: Aug. 25, 2014

(65) Prior Publication Data

US 2015/0072543 A1 Mar. 12, 2015

Related U.S. Application Data

(60) Provisional application No. 61/874,626, filed on Sep. 6, 2013, provisional application No. 61/984,942, filed on Apr. 28, 2014.

(51) Int. Cl.
*H01R 4/58* (2006.01)
*H01R 4/48* (2006.01)
(Continued)

(52) U.S. Cl.
CPC ..... *H01R 4/48* (2013.01); *H01R 12/7076* (2013.01); *H01R 13/2421* (2013.01); *H01R 12/58* (2013.01)

(58) Field of Classification Search
CPC ..... H01R 4/48
USPC ..... 439/66, 81
See application file for complete search history.

(56) References Cited

U.S. PATENT DOCUMENTS 5,388,997 A * 2/1995 Grange et al. ..... 439/66
5,388,998 A * 2/1995 Grange et al. ..... 439/66
(Continued)

FOREIGN PATENT DOCUMENTS

JP 2003100375 9/2001
JP 2002014113 1/2002
(Continued)

OTHER PUBLICATIONS

Extended European Search Report, EP14183464, Feb. 2, 2015, European Patent Office.

*Primary Examiner* — Abdullah Riyami
*Assistant Examiner* — Nelson R Burgos-Guntin
(74) *Attorney, Agent, or Firm* — Chapin IP Law, LLC

(57) ABSTRACT

In an embodiment, a stepped spring contact may have a first portion, a transition portion, and a second portion. The first portion may include a plurality of windings whose pitch may vary. The second portion may include a plurality of windings that are closely wound. A pitch of the windings contained in the second portion may be, for example, constant. The transition portion may include a winding that may make mechanical and electrical contact with a first electrical conductor (e.g., a pad contained on a printed circuit board (PCB)). The first portion may include a tip. The tip may be, for example, flat shaped or conically shaped. The tip may make electrical contact with a second electrical conductor (e.g., a terminal connector). In operation, the stepped spring contact may provide electrical continuity between the first electrical conductor and the second electrical conductor.

20 Claims, 12 Drawing Sheets

(51) Int. Cl.

| | |
|---|---|
| ***H01R 13/24*** | (2006.01) |
| ***H01R 12/70*** | (2011.01) |
| *H01R 12/58* | (2011.01) |

(56) References Cited

U.S. PATENT DOCUMENTS

| | | | | |
|---|---|---|---|---|
| 6,313,523 | B1 * | 11/2001 | Morris et al. | 257/696 |
| 6,341,962 | B1 * | 1/2002 | Sinclair | 439/66 |
| 6,776,668 | B1 * | 8/2004 | Scyoc et al. | 439/700 |
| 7,666,000 | B1 * | 2/2010 | Hsiao et al. | 439/66 |
| 7,695,285 | B2 * | 4/2010 | Sugiura et al. | 439/66 |
| 7,946,855 | B2 * | 5/2011 | Osato | 439/66 |
| 8,263,879 | B2 * | 9/2012 | Hougham et al. | 174/262 |
| 8,373,430 | B1 * | 2/2013 | Sochor | 324/755.05 |
| 8,556,638 | B2 * | 10/2013 | Tsubaki et al. | 439/66 |
| 8,734,190 | B2 * | 5/2014 | Schlitzkus et al. | 439/700 |
| 8,758,067 | B2 * | 6/2014 | Rathburn | 439/700 |
| 8,919,656 | B2 * | 12/2014 | Eckerdt | 235/492 |
| 2011/0290539 | A1 * | 12/2011 | Willner et al. | 174/255 |
| 2015/0072543 | A1 * | 3/2015 | Willner et al. | 439/81 |

FOREIGN PATENT DOCUMENTS

| | | |
|---|---|---|
| JP | 2002170617 | 6/2002 |
| JP | 2010153321 | 7/2010 |
| WO | 2014042264 A1 | 3/2014 |

* cited by examiner

STEPPED SPRING CONTACT

RELATED APPLICATIONS

This application claims priority to and the benefit of U.S. Provisional Patent Application No. 61/874,626, filed on Sep. 6, 2013 and titled "Stepped Spring Contact", and U.S. Provisional Patent Application No. 61/984,942, filed on Apr. 28, 2014 and titled "Stepped Spring Contact". The contents of the above-described applications are incorporated by reference as though fully set forth herein.

BRIEF DESCRIPTION OF DRAWINGS

The accompanying drawings, which are incorporated in and constitute a part of this specification, illustrate one or more embodiments described herein and, together with the description, explain these embodiments. In the drawings.

DETAILED DESCRIPTION

A stepped spring contact may be a spring contact that is stepped. The contact may be stepped in that portions of the contact may, for example, vary in diameter. For example, a stepped spring contact may include a first portion and a second portion. A diameter of the first portion may be different (e.g., greater than, less than) a diameter of the second portion.

A stepped spring contact may include multiple windings. A distance from a center of a winding to a center of the next winding may be referred to as pitch. A length of the stepped spring contact when at rest (e.g., when not in operation) may be referred to as a free length of the stepped spring contact.

A stepped spring contact may be used to provide electrical continuity between two points in an electronic device. For example, a device, such as a micro-strain gauge (MSG) sensor, may have a connector terminal and a printed circuit board (PCB). Electrical continuity between the connector terminal and the PCB may be made using one or more stepped spring contacts.

As will be described in further detail below, an embodiment of a stepped spring contact may have a first portion, a transition portion, and a second portion. The first portion may include a plurality of windings whose pitch may vary. The second portion may include a plurality of windings that are closely wound. A pitch of the windings contained in the second portion may be, for example, constant. The transition portion may include a winding that may make mechanical and electrical contact with a first electrical conductor that may include, for example, a pad contained on a PCB. The first portion may include a tip. The tip may be, for example, flat shaped, round shaped, or conically shaped. The tip may make electrical contact with a second electrical conductor (e.g., a terminal connector). In operation, the stepped spring contact may provide electrical continuity between the first electrical conductor and the second electrical conductor.

Figure 1:
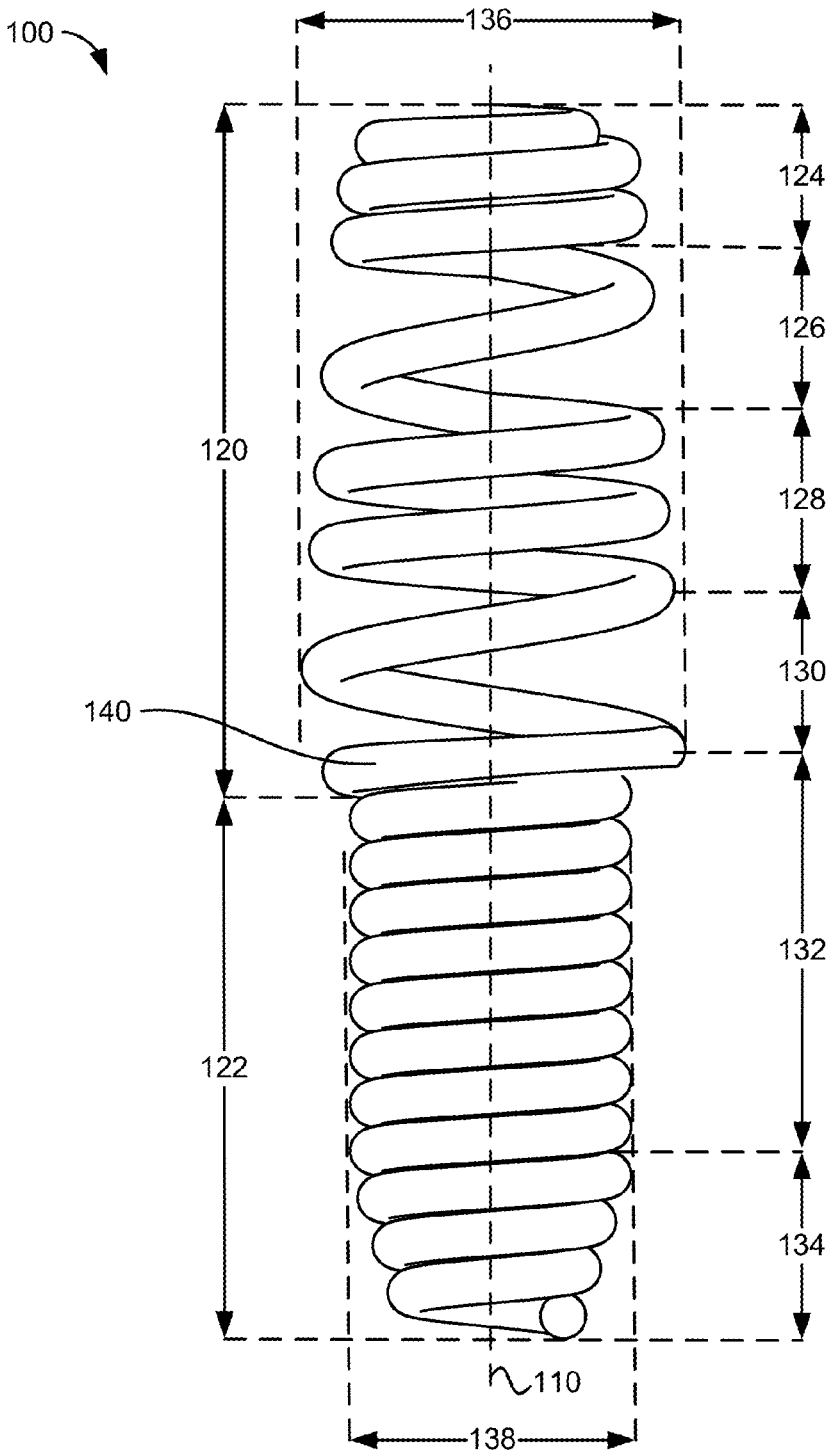
FIG. 1 illustrates an example embodiment of a stepped spring contact.

FIG. 1 illustrates an example first embodiment of a stepped spring contact 100. The stepped spring contact 100 may include an electrically conductive material (e.g., silver plated metal). The stepped spring contact 100 may be used in combination with, for example, a PCB and a connector terminal to provide electrical continuity between the PCB and the connector terminal.

Referring to FIG. 1, the stepped spring contact may include a first portion 120 and a second portion 122. A diameter 136 of the first portion 120 may be greater than a diameter 138 of the second portion 122. In an embodiment, a free length of stepped spring contact 100 may be 6.82 millimeters (mm). Here, the first portion 120 may have a length of 3.81 mm and the second portion 122 may have a length of 3.01 mm. Moreover, in this embodiment, diameter 136 at its widest point may be 2.15 mm and diameter 138 at its widest point may be 1.55 mm.

The first portion 120 may include various sections. These section may include, for example, a tip 124, a first active winding portion 126, a second active winding portion 128, a third active winding portion 130, and a transition portion 140. The first portion 120 may be tapered towards the tip 124.

Windings in the first portion 120 may vary in pitch. The varied pitch may, for example, obviate a propensity for the stepped spring contact 100 to tangle with other stepped spring contacts 100 during handling of the stepped string contacts 100.

The first portion 120 may include one or more active windings. The active windings may be part of an active winding region which may include, for example, the first active winding portion 126, the second active winding portion 128, and the third active winding portion 130. Axis 110 may represent an axis that may be associated with a center of the stepped spring contact 100.

Tip 124 may include one or more windings. The windings may be close-spaced. A close-spaced winding may include a winding that, for example, is tightly wound such that little to no space may be contained between the windings. Here, for example, the pitch of the windings may be minimal. An example of close-spaced windings are closed windings.

One or more windings may be tapered towards tip 124. Tip 124 may have an end that may have, for example, a flat shape. The flat shape may be, for example, flat or substantially flat. As will be described below, the end may make electrical contact with, for example, an electrically conductive connector terminal.

In an embodiment, tip 124 may be 0.83 mm in length and contain three close-spaced windings. The close-spaced windings may be tightly wound such that the close-spaced windings span the entire length of tip 124.

The first active winding portion 126 may include one or more wide-spaced windings. A wide-spaced winding may include a winding that, for example, may be loosely wound such that space may be contained between the windings. The space between the windings may be substantial when compared to, for example, close-spaced windings. Moreover, the pitch of wide-spaced windings may be, for example, greater than the pitch of close-spaced windings. An example of a wide-spaced winding is an open-space winding.

For example, suppose stepped spring contact 100 is made from wire having a single gauge. Close-spaced windings contained in stepped spring contact 100 may be closely wound such that a pitch of the close-spaced windings may be, for example, minimal. The close-spaced windings may be considered closed windings. Wide-spaced windings contained in the stepped spring contact 100, on the other hand, may be loosely wound such that a pitch of the wide-spaced windings may be greater than the pitch of the close-spaced windings. The wide-spaced windings may be considered open windings.

A pitch of windings contained in the first active winding portion 126 may differ from pitches of windings in other sections of the first portion 120. For example, the pitch of windings contained in the first active winding portion 126 may be greater than the pitch of windings in tip 124 and/or the second active winding portion 128.

In an embodiment, the first active winding portion 126 may be 0.89 mm in length. Moreover, the first active winding portion 126 may contain a single wide-spaced winding that spans the entire length of the first active winding portion 126. It should be noted, however, that in other embodiments, the first active winding portion 126 may include multiple windings and/or the first active winding portion may be other lengths. Moreover, it should be noted that in other embodiments, windings contained in the first active winding portion 126 may include some combination of close-spaced windings and wide-spaced windings.

The second active winding portion 128 may include one or more wide-spaced windings. A pitch of windings contained in the second active winding portion 128 may differ from pitches of windings in other sections of the first portion 120. For example, the pitch of windings contained in the second active winding portion 128 may be greater than the pitch of windings in tip 124. Moreover, the pitch of windings in the second active winding portion 128 may, for example, be less than the pitch of windings in the first active winding portion 126.

In an embodiment, the second active winding portion 128 may be 0.95 mm in length. Moreover, the second active winding portion 128 may contain multiple wide-spaced windings that span the entire length of the second active winding portion 128. For example, the second active winding portion 128 may include two wide-spaced windings. The two wide-spaced windings combined may span the entire length of the second active winding portion 128.

The third active winding portion 130 may include one or more wide-spaced windings. A pitch of windings in the third active portion 130 may differ from pitches of windings in other sections of the first portion 120. For example, the pitch of windings contained in the third active winding portion 130 may be greater than the pitch of windings in tip 124 and/or windings in the second active winding portion 128.

In an embodiment, the third active winding portion 130 may be 0.95 mm in length. Moreover, the third active winding portion 130 may contain one or more wide-spaced windings that span the entire length of the third active winding portion 130. For example, the third active winding portion 130 may include a single wide-spaced winding that spans the entire length of the third active winding portion 130.

It should be noted, however, that in other embodiments, the third active winding portion 130 may include a multiple windings. In addition or alternatively, in other embodiments, the third active winding portion 130 may span other lengths. Moreover, in other embodiments, windings contained in the third active winding portion 130 may include some combination of close-spaced windings and wide-spaced windings.

As noted above, a pitch associated with windings in the first active winding portion 126 and the third active portion 130 may be greater than a pitch associated with the windings in tip 124 and/or the second active portion 128. Moreover, the pitch associated with windings in the second active portion 128 may be greater than tip 124 and/or less than the pitch of windings in the first active winding portion 126 and/or third active winding portion 130.

For example, in an embodiment, all windings in the tip 124 have a first pitch, all windings in the first active portion 126 have a second pitch, all windings in the second active portion 128 have a third pitch, and all windings in the third active portion 130 have a fourth pitch. In this embodiment, the first pitch is less than the second, third, and fourth pitches. In addition, in this embodiment, the third pitch is less than the second pitch and fourth pitch. Moreover, in this embodiment, the second pitch and fourth pitch are the same.

It should be noted that the above embodiment is an example of how pitches in the first portion 120 may be varied. In other embodiments, different combinations of sizes for the first, second, third, and fourth pitches may be used. Generally, utilizing varied pitches for tip 124, first active winding portion 126, second active winding portion 128, and/or third active winding portion 130 may, for example, obviate a propensity for tangling that may occur between multiple stepped spring contacts 100 during handling of the stepped string contacts 100.

The transition portion 140 may include one or more windings that may transition from the first portion 120 to the second portion 122. The diameter of the transition portion 140 may be greater than the diameter 138 of the second portion 122. In addition, the diameter of the transition portion may be less than the diameter of the third active winding portion 130.

Moreover, the transition portion 140 may include a winding that may be angled with respect to axis 110. For example, the transition portion 140 may include a winding that is at an angle of between 1 and 20 degrees, inclusive, with respect to axis 110.

As will be described further below, in an operation of the stepped spring contact 100, a portion of the transition portion 140 may rest against an electrically conductive pad on a PCB and make electrical contact with the pad.

The second portion 122 may include a stem 132 and a tip 134. Stem 132 may include one or more windings. The windings may be close-spaced windings. A pitch of windings contained in the second portion 122 may be constant. For example, in an embodiment, all windings in the second portion 122 have the same pitch.

Windings in the second portion 122 may taper towards tip 134. Tip 134 may include one or more windings. The windings may be close-spaced and may taper inwards towards axis 110. A pitch of windings contained in tip 134 may be constant. It should be noted that in other embodiments, the second portion 122 may include one or more wide-spaced windings. Moreover, in other embodiments, pitches of windings contained in the second portion 122 may vary.

Figure 2:
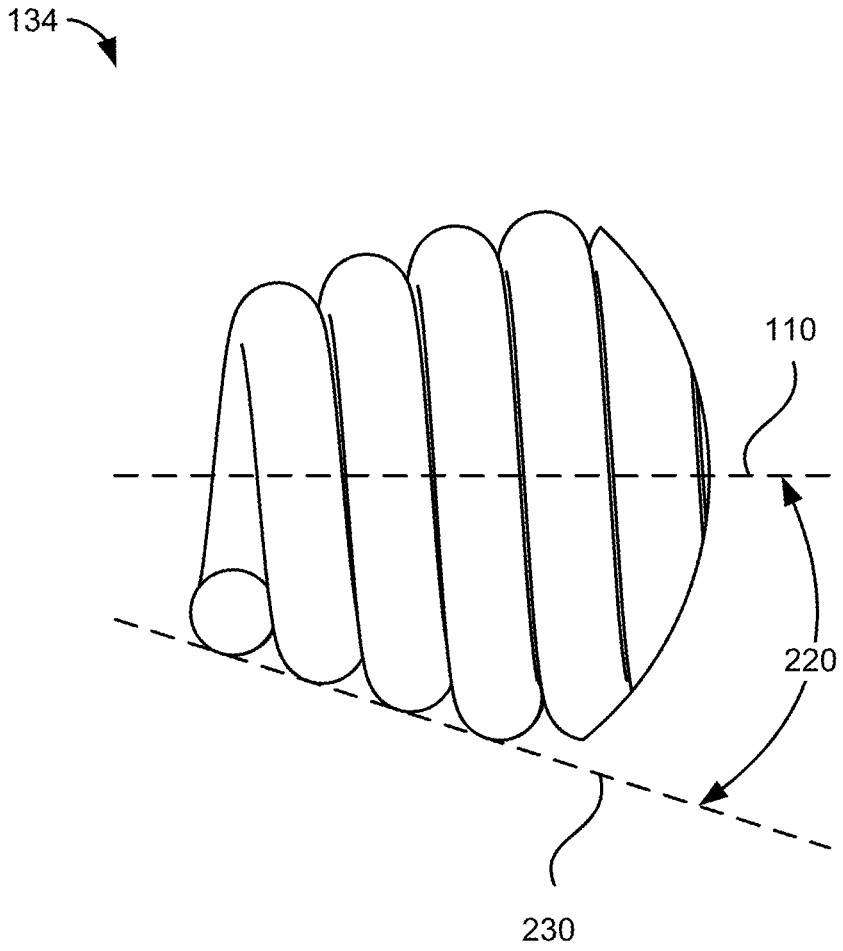
FIG. 2 illustrates a side view of a tip of the stepped spring contact illustrated in FIG. 1.

FIG. 2 illustrates a side view of tip 134. Referring to FIG. 2, tip 134 may include one or more windings. For example, tip 134 may include three windings. Line 230 may be tangential to windings included in the tip 134 and may indicate a taper of the windings.

An envelope angle of tip diameter transition zone 220 may be identified based on, for example, the taper of the windings indicated by line 230 with respect to axis 110. The envelope angle of tip diameter transition zone 220 may represent an angle (e.g., in degrees) between line 230 and axis 110. In an embodiment, the envelope angle of tip diameter transition zone 220 may be 18 degrees. It should be noted that in other embodiments, the envelope angle of tip diameter transition zone 220 may be other values. For example, in other embodiments, the envelope angle of tip diameter transition zone 220 may be between 10 and 80 degrees.

Figure 3A:
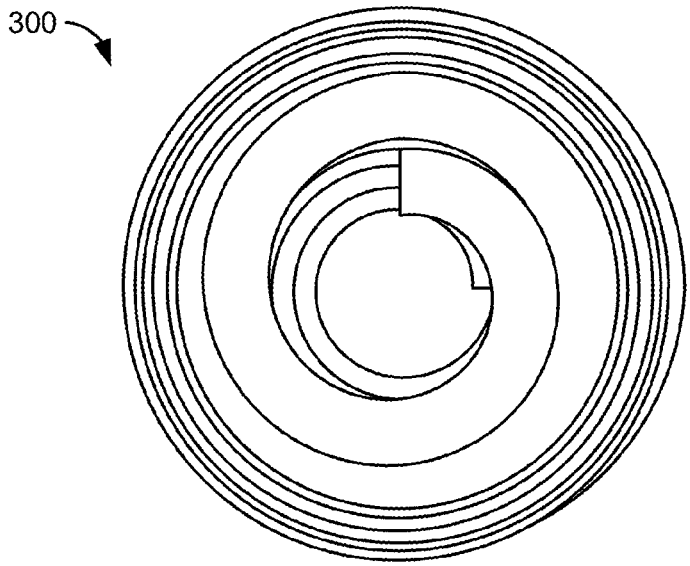
FIGS. 3A-B illustrate a top-down view and cut-away view, respectively, of a first end of the stepped spring contact illustrated in FIG. 1.
Figure 3B:
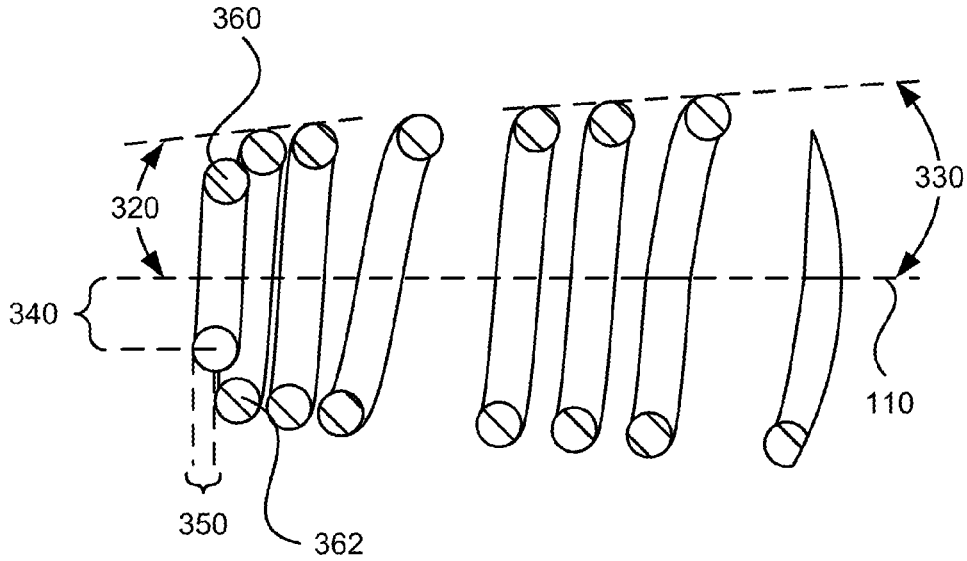

FIGS. 3A and 3B illustrate a top-down view and cut-away view, respectively, of windings in the first portion 120. Specifically, FIG. 3A illustrates a top down view 300 of stepped spring contact 100 when viewed top down from the first portion 120 to the second portion 122. Referring to FIG. 3A, windings in the first portion 120 may taper inward towards the center of the stepped spring contact 100.

FIG. 3B illustrates a cut-away view of windings in the first portion 120. Windings contained in different sections of the first portion 120 may be wound such they may taper inwards towards axis 110 at different angles.

Angle 320 may represent, for example, a degree of taper of a first section of windings in the first portion 120. Windings in this first section may include, for example, windings that may be contained in tip 124. In an embodiment, angle 320 may be 7 degrees which may indicate that windings contained in the first section may be wound such that the first section of the first portion 120 tapers inwards towards axis 110 at a 7 degree angle. It should be noted, however, that in other embodiments, angle 320 may range between be between 1 and 15 degrees.

Angle 330 may represent, for example, a degree of taper of a second section of windings in the first portion 120. Windings in this second section may include, for example, windings that may be contained in the second active winding portion 128 and/or the third active winding portion 130. In an embodiment, angle 330 may be 4 degrees which may indicate that windings in the second section may be wound such that the second section of the first end taper inwards towards axis 110 at a 4 degree angle.

Winding 360 may be an outermost winding of the first portion 120. Winding 360 may be wound such that a portion of winding 360 may turn inward towards axis 110. A degree in which winding 360 turns inward towards axis 110 may be represented by measurement 340. Specifically, measurement 340 may indicate, for example, a distance from axis 110 to a center point of winding 360 of the first end. In an embodiment, a value of measurement 340 may, for example, be 0.4 mm maximum. Note that in other embodiments, other values of measurement 340 may be used.

Winding 362 may be adjacent to winding 360 and may be considered a second outermost winding of the first portion 120. Winding 360 may be wound such that a portion of winding 360 may be recessed within winding 362 and a different portion of winding 360 may lie outside of winding 362. Measurement 350 may indicate, for example, a degree in which winding 360 may lie outside of winding 362. In an embodiment, a value of measurement 350 may, for example, be 0.12 mm with a tolerance of plus or minus 0.10 mm. It should be noted, however, that in other embodiments, other values and/or tolerances for measurement 350 may be used.

Figure 4A:
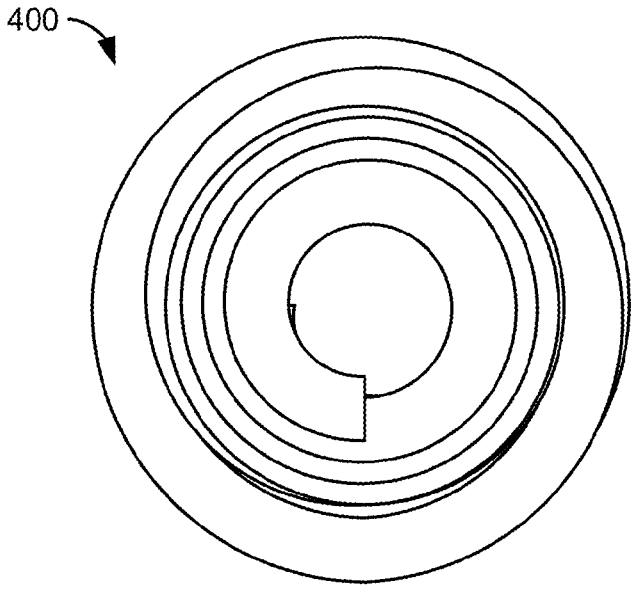
FIGS. 4A-B illustrate a top-down view and cut-away view, respectively, of a second end of the stepped spring contact illustrated in FIG. 1.
Figure 4B:
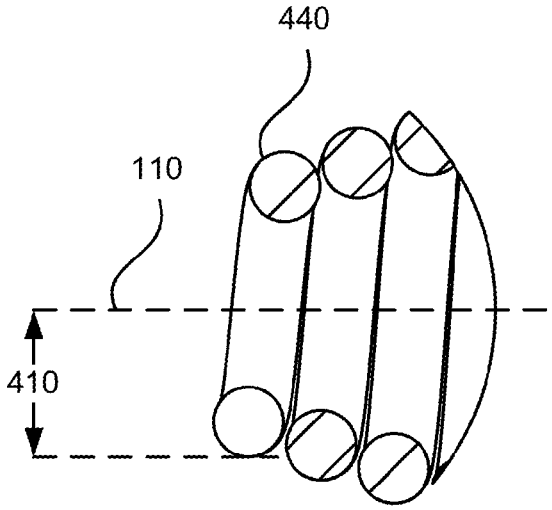

FIGS. 4A and 4B illustrate a top-down view and cut-away view, respectively, of windings in the second portion 122. Specifically, FIG. 4A illustrates a view 400 of stepped spring contact 100 when viewed top down from the second portion 122 towards the first portion 120. Note that, one or more windings at the second portion 122 may turn inwards toward the center of the stepped spring contact 100.

FIG. 4B illustrates a cut-away view of the second end. Referring to FIG. 4B, measurement 410 may indicate a degree in which an outermost winding 440 in the second portion 122 may turn inwards towards the center of the stepped spring contact 100. In an embodiment, measurement 410 may be a maximum of 0.525 mm. It should be noted, however, that in other embodiments, other values for measurement 410 may be used.

Figure 5:
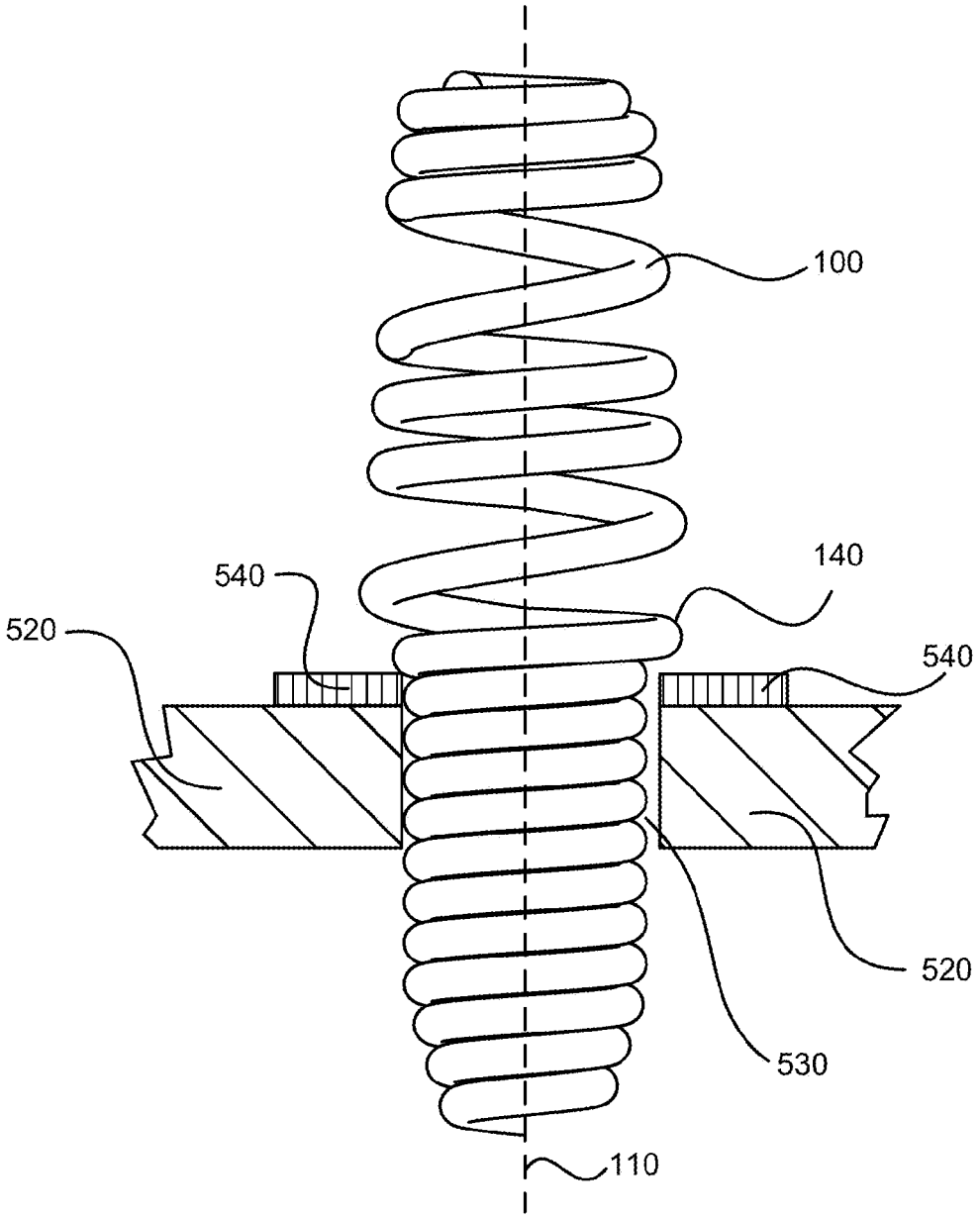
FIG. 5 illustrates an example mounting of the stepped spring contact illustrated in FIG. 1.

FIG. 5 illustrates an example mounting of stepped spring contact 100. Referring to FIG. 5, stepped spring contact 100 may be mounted through a hole 530 contained in a PCB 520. Hole 530 may include a plated through-hole. The plated through-hole may be plated with an electrically conductive material such as, for example, an electrically conductive metal.

Pad 540 may contain an electrically conductive material such as, for example, an electrically conductive metal. Pad 540 may make electrical contact with an electrical lead that may be contained on PCB 520. In an embodiment, hole 530 includes a plated through-hole and pad 540 is part of the plated through-hole.

After stepped spring contact 100 is mounted in hole 530, a portion of a winding in the transition portion 140 may rest on pad 540 and provide an electrically conductive path between pad 540 and stepped spring contact 100. Moreover, one or more windings associated with the second portion 122 (FIG. 1) of stepped spring contact 100 may provide an electrically conductive path between pad 540 and stepped spring contact 100. For example, in an embodiment, hole 530 is a plated through hole and one or more windings associated with stem 132 make electrical contact with the plated through hole thereby providing an electrically conductive path between pad 540 and stepped spring contact 100 via stem 132.

Figure 6:
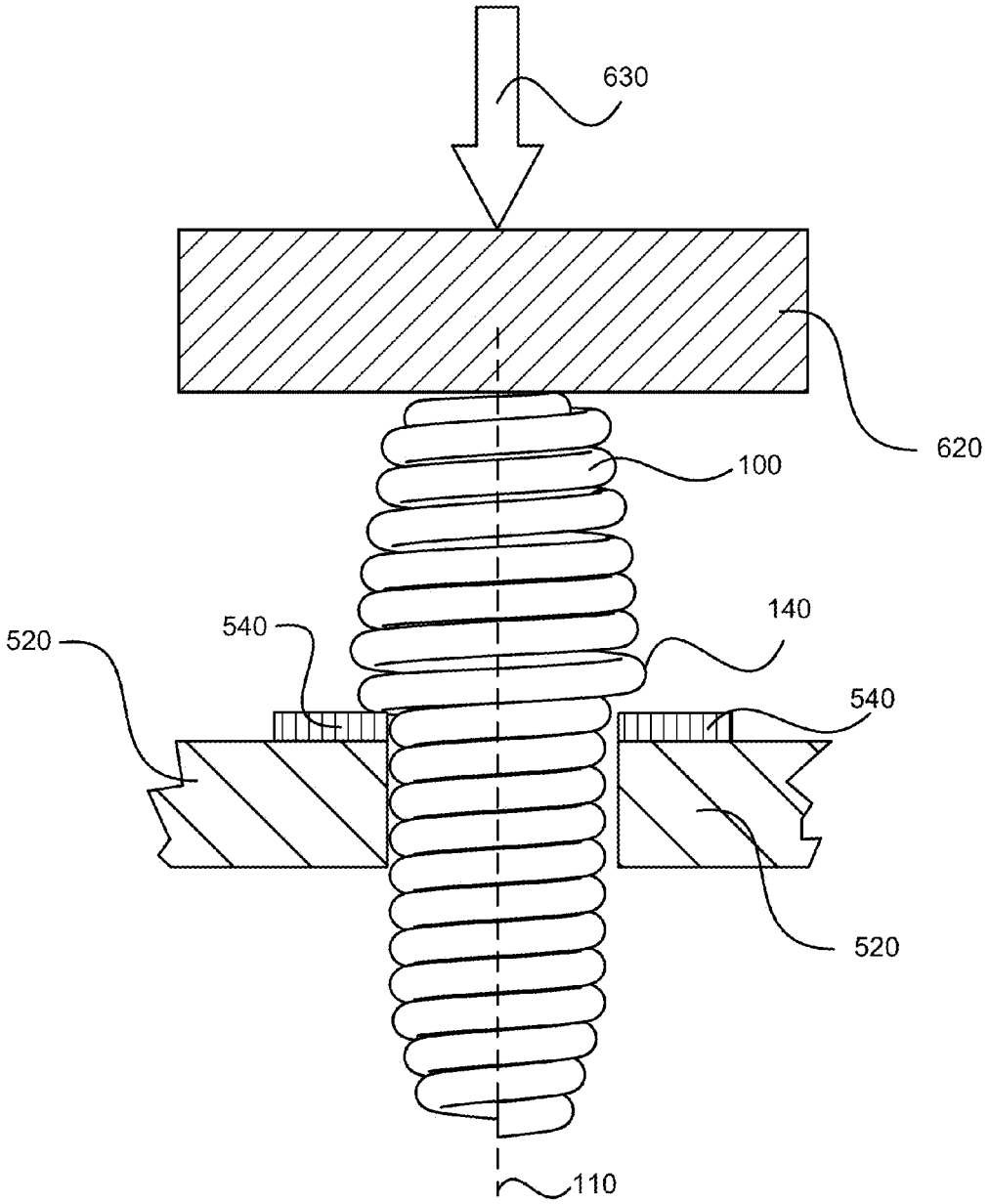
FIG. 6 illustrates an example operation of the stepped spring contact illustrated in FIG. 1.

FIG. 6 illustrates an example operation of stepped spring contact 100. Referring to FIG. 6, a force 630 (e.g., pressure) may be applied to the stepped spring contact 100 by, for example, a connector terminal 620. Applying the force 630 may cause an electrically conductive portion of the connector terminal 620 to make mechanical contact with the stepped spring contact 100 and form an electrical path between the connector terminal 620 and the stepped spring contact 100.

Moreover, applying force 630 may cause one or more active windings associated with the stepped spring contact 100 to compress, thereby, exerting a force on one or more windings in the transition portion 140. The force on windings in the transition portion 140 may cause at least a portion of the windings to make mechanical contact with pad 540 and form an electrical path between connector terminal 620 through stepped spring contact 100 to pad 540.

Note that stepped spring contact 100, PCB 520, and connector terminal 620 may be contained in a device such as, for example, an MSG sensor. It should be noted, however, that stepped spring contact 100 may be used in other devices to provide electrical continuity between two points in the devices.

Note also that stepped spring contact 100 may be used to provide electrical continuity between items other than a PCB and a connector terminal. For example, stepped spring contact 100 may be used to provide electrical continuity between two different PCBs that may be contained in a device.

Figure 7:
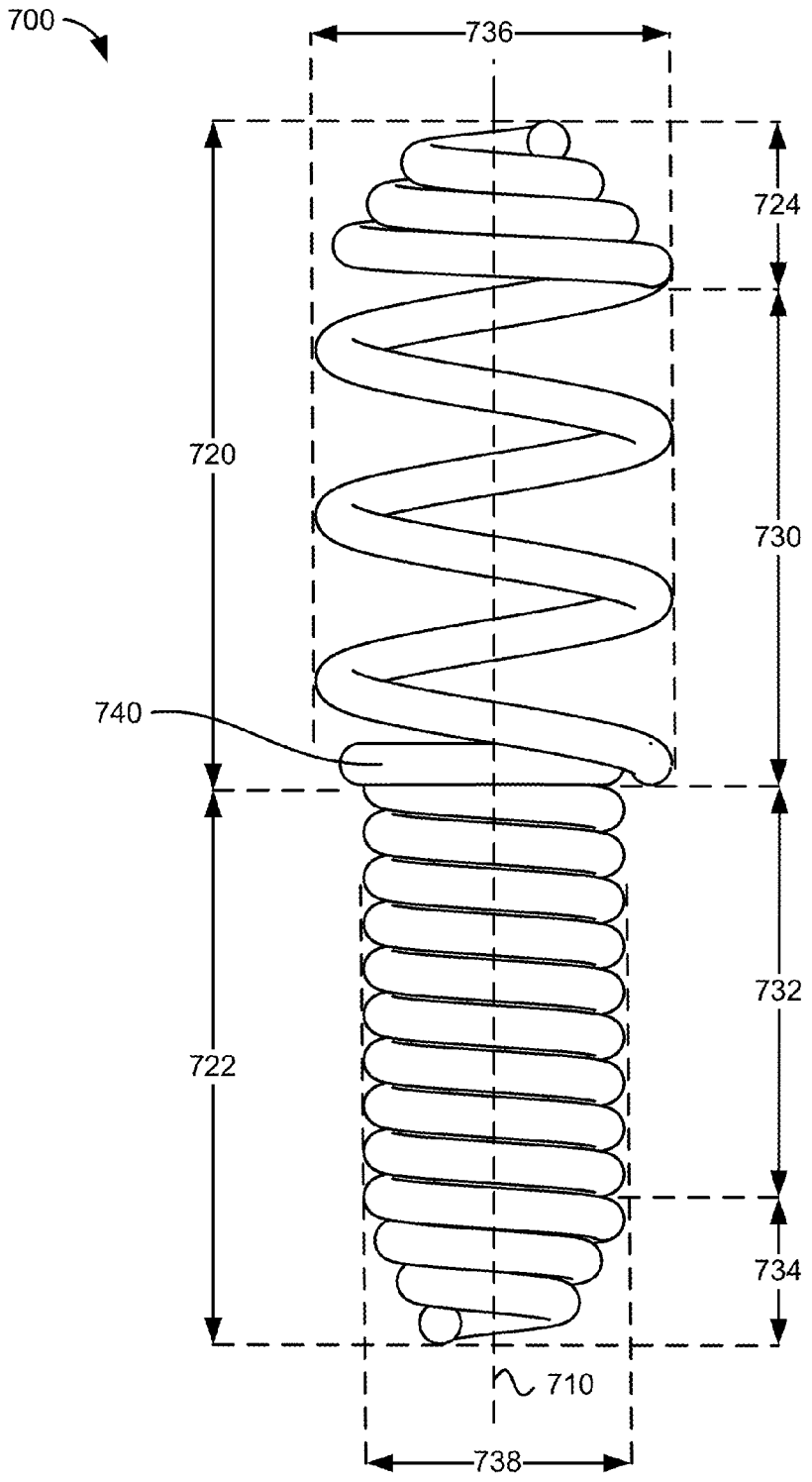
FIG. 7 illustrates an example second embodiment of a stepped spring contact.

FIG. 7 illustrates another example embodiment of a stepped spring contact 700. The stepped spring contact 700 may be made of an electrically conductive material (e.g., silver plated metal). The stepped spring contact 700 may be used in combination with, for example, a PCB to provide an electrical continuity between the PCB and a connector terminal. The PCB and connector terminal may be part of a device such as, for example, an MSG sensor.

Referring to FIG. 7, the stepped spring contact 700 may include a first portion 720 and a second portion 722. The first portion 720 may include tip 724, an active winding portion 730, and a transition portion 740. The second portion may include a stem 732 and tip 734. A diameter 736 of the first portion 720 may be greater than a diameter 738 of the second portion 722. Axis 710 may represent an axis that may be associated with a center of the stepped spring contact 700.

In an embodiment, a free length of stepped spring contact 700 may be, for example, 7.38 mm, where the first portion 720 may have a length of 4 mm and the second portion 722 may have a length of 3.38 mm. Moreover, diameter 736 at its widest point may be, for example, 2.15 mm and diameter 738 at its widest point may be, for example, 1.57 mm.

Tip 724 may include one or more windings. The windings may be close-spaced. One or more of the windings in tip 724 may be tapered at an end to form, for example, a conical shaped or round shaped. For example, tip 724 may have an end that is conical, rounded, or substantially conical or rounded. As will be described further below, this end of tip 724 may make electrical contact with, for example, a cavity which may be part of an electrically conductive connector terminal.

In an embodiment, tip 724 may be, for example, 0.875 mm in length. Moreover, tip 724 may include three close-spaced windings. The close-spaced windings may be tightly wound such that the close-spaced windings combined span the entire length of the tip 724.

Active winding portion 730 may include one or more active windings for stepped spring contact 700. One or more of the active windings may be wide-spaced. A pitch of one or more of the active windings may be greater than a pitch of windings contained in the tip 724 and/or the second portion 722.

In an embodiment, the active winding portion 730 may be 0.88 mm in length. Moreover, the active winding portion 730 may contain three wide-spaced windings that together span the entire length of the active winding portion 730. It should be noted, however, that in other embodiments, the active winding portion 730 may include other numbers of windings. Moreover, in other embodiments the active winding portion 730 may include windings that have, for example, a pitch that is less than the pitch of the wide-spaced windings. In addition, in other embodiments, windings in the active winding portion 730 may span other lengths.

The transition portion 740 may include one or more windings that may transition from the first portion 720 to the second portion 722. A diameter of the transition portion 740 may be greater than the diameter 738 of the second portion 722. Moreover, the diameter of the transition portion 740 may be less than the diameter 736 of the first portion 720. In addition, transition portion 740 may include a winding that may be perpendicular or substantially perpendicular to axis 710. As will be described further below, in an operation of the stepped spring contact 700, a portion of the transition portion 740 may rest against an electrically conductive pad on a PCB and make electrical contact with the pad.

In the second portion 722, stem 732 may include one or more close-spaced windings. The windings may taper towards tip 734. Tip 734 may include one or more or more windings which may, for example, taper inwards towards axis 710.

It should be noted that a pitch associated with windings in the active winding portion 730 may vary. Utilizing varied pitches for windings in the active winding portion 730 may obviate, for example, tangling that may occur between multiple stepped spring contacts 700.

Figure 8A:
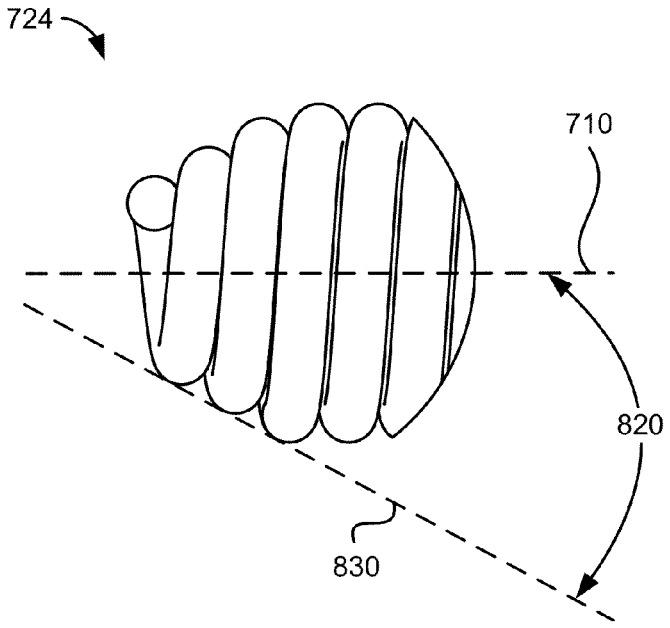
FIGS. 8A-B illustrates a side-view of first tip and a second tip, respectively, of the stepped spring contact illustrated in FIG. 7.

FIG. 8A illustrates a side view of tip 734. Referring to FIG. 8A, tip 734 may include one or more windings. Line 830 may be tangential to one or more windings included in tip 734 and may represent, for example, a taper associated with the one or more windings. An envelope angle of tip diameter transition zone 820 may be identified based on, for example, a taper of the windings. The envelope angle of tip diameter transition zone 820 may be measured with respect to axis 710. In an embodiment, the envelope angle of tip diameter transition zone 820 may be 28.3 degrees. It should be noted that the envelope angle of tip diameter transition zone 820 may vary in other embodiments of stepped spring contact 700. For example, in other embodiments, the envelope angle of tip diameter transition zone 820 may be between 10 and 80 degrees.

Figure 8B:
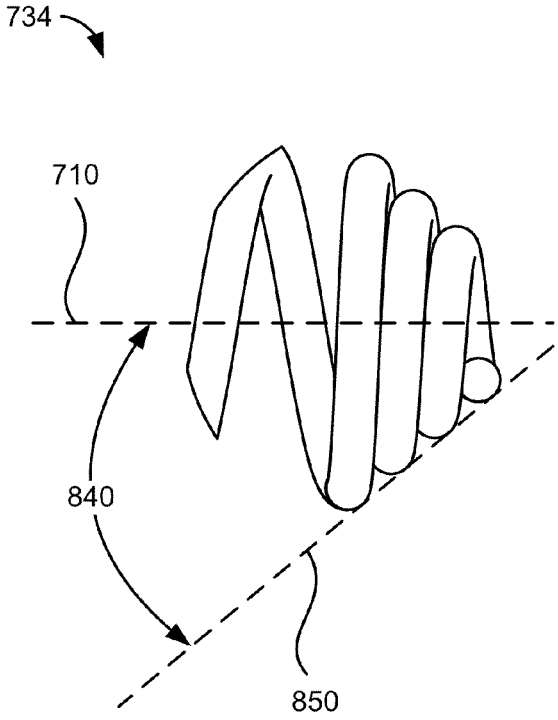

FIG. 8B illustrates a side view of tip 724. Referring to FIG. 8B, tip 724 may include one or more windings. Line 850 may be tangential to one or more windings included in tip 724 and may represent, for example, a taper associated with the one or more windings. An envelope angle of tip diameter transition zone 840 may be identified based on, for example, a taper of the windings. The envelope angle of tip diameter transition zone 840 may be measured with respect to axis 710. In an embodiment, the envelope angle of tip diameter transition zone 840 may be 28.3 degrees. It should be noted that the envelope angle of tip diameter transition zone 820 may vary in other embodiments of stepped spring contact 700. For example, in other embodiments, the envelope angle of tip diameter transition zone 840 may be between 10 and 80 degrees.

Figure 9A:
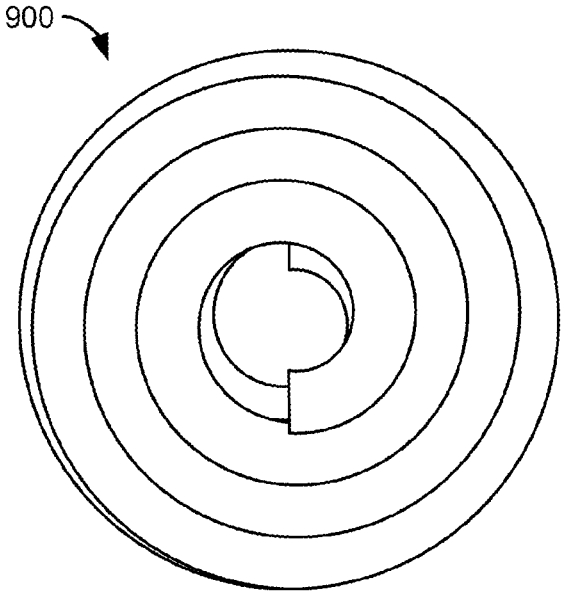
FIGS. 9A-B illustrate a top-down view and a cut-away view, respectively, of the second tip of the stepped spring contact illustrated in FIG. 7.
Figure 9B:
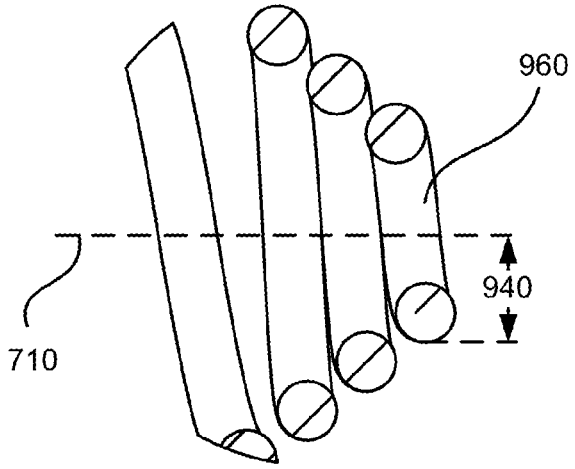

FIGS. 9A and 9B illustrate a top-down view and cut-away view, respectively, of windings in first portion 720. Specifically, FIG. 9A illustrates a view 900 of stepped spring contact 700 when viewing the first portion 720 top down towards the second portion 722. Note that windings in the first portion 720 may taper inward towards the center of the stepped spring contact 700.

FIG. 9B illustrates a cut-away view of windings contained in the first portion 720. Winding 960 may be an outermost winding in the first portion 720. Winding 960 may be wound such that a portion of winding 960 may turn inward towards axis 710.

Measurement 940 may indicate a radius of winding 960. In an embodiment, a value of measurement 940 may be, for example, 0.45 mm maximum. Note that in other embodiments, other values of measurement 940 may be used.

Figure 10A:
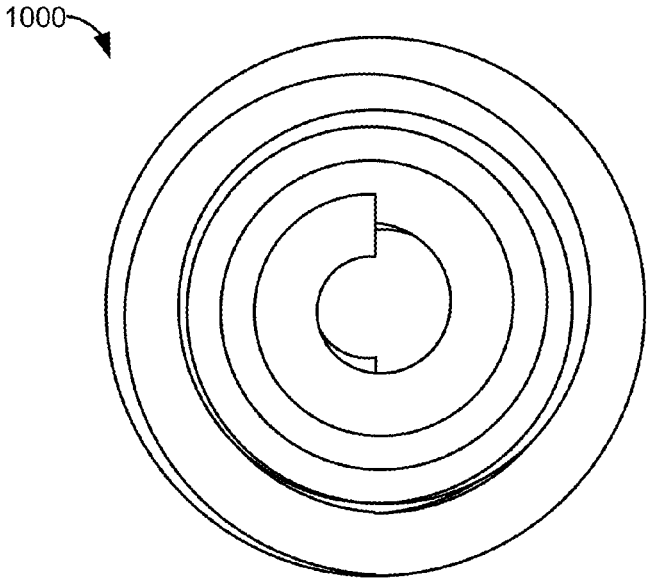
FIGS. 10A-B illustrate a top-down view and a cut-away view, respectively, of the first tip of the stepped spring contact illustrated in FIG. 7.
Figure 10B:
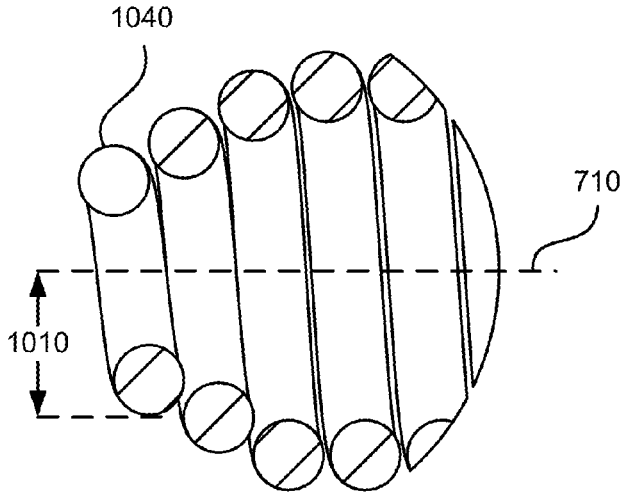

FIGS. 10A and 10B illustrate a top-down view and cut-away view, respectively, of windings in the second portion 722. Specifically, FIG. 10A illustrates a view 1000 of stepped spring contact 700 when viewed top down from the second portion 722. Note that, one or more windings at the second portion 722 may turn inwards toward the center of the stepped spring contact 700.

FIG. 10B illustrates a cut-away view of windings in the second portion 722. Referring to FIG. 10B, winding 1040 may be an outermost winding in the second portion 722.

Winding 1040 may be wound such that a portion of winding 1040 may turn inward towards axis 710.

Measurement 1010 may indicate a radius of winding 1040. In an embodiment, a value of measurement 1010 may, for example, be 0.45 mm maximum. Note that in other embodiments, other values of measurement 1010 may be used.

Figure 11:
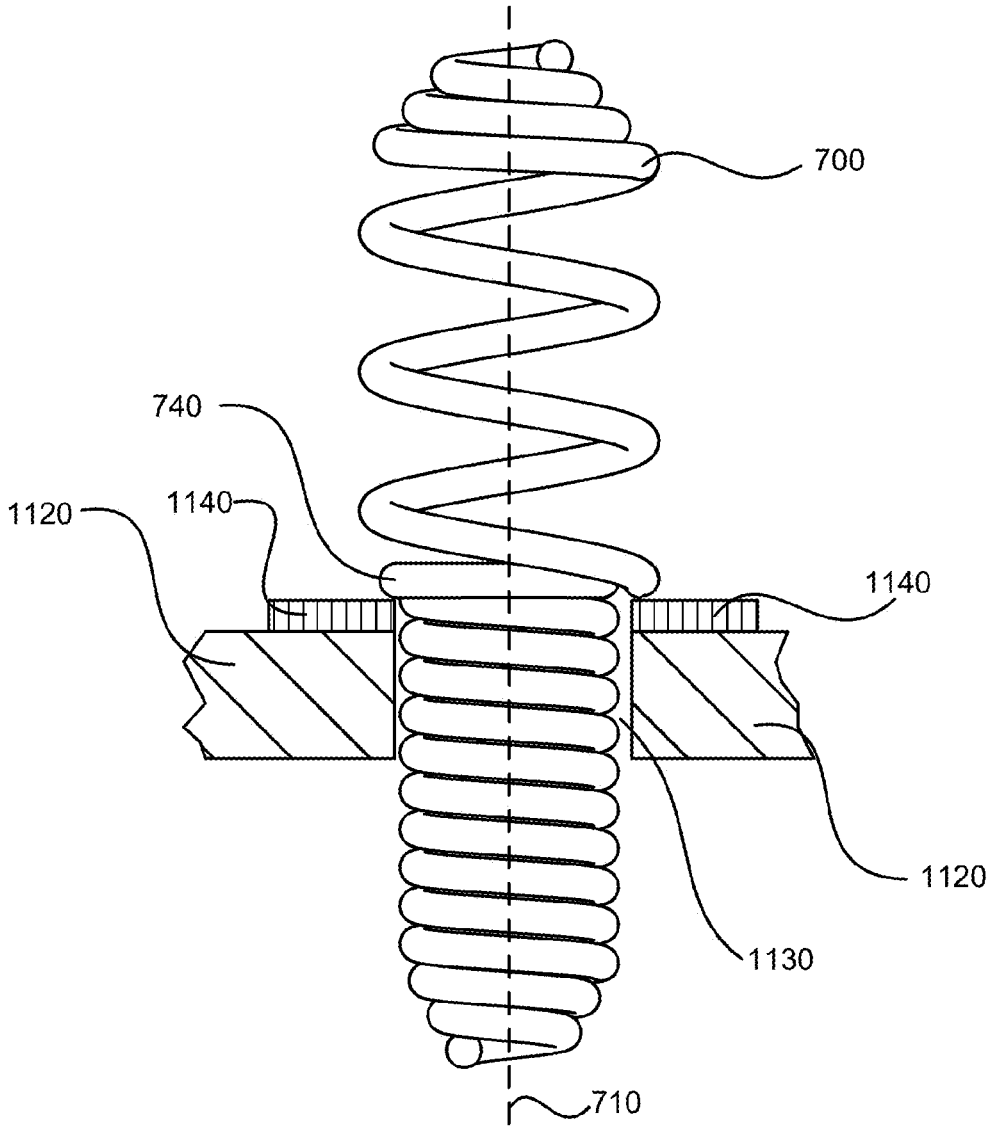
FIG. 11 illustrates an example mounting of the stepped spring contact illustrated in FIG. 7.

FIG. 11 illustrates an example mounting of stepped spring contact 700. Referring to FIG. 11, stepped spring contact 700 may be mounted through a hole 1130 contained in a PCB 1120. Hole 1130 may include a plated through-hole. The plated through-hole may include an electrically conductive material such as, for example, an electrically conductive metal.

Pad 1140 may contain an electrically conductive material such as, for example, an electrically conductive metal. Pad 1140 may make electrical contact with an electrical lead that may be contained on PCB 1120. In an embodiment, hole 1130 includes a plated through-hole that includes pad 1140.

When mounted in hole 1130, a portion a winding in the transition portion 740 may rest on pad 1140 and provide an electrically conductive path between pad 1140 and stepped spring contact 700. Moreover, one or more windings associated with the second portion 722 (FIG. 7) of stepped spring contact 700 may provide an electrically conductive path between pad 1140 and stepped spring contact 700.

For example, in an embodiment, hole 1130 is a plated through-hole and one or more windings associated with the second portion 722 make electrical contact with the plated through-hole thereby providing an electrically conductive path between pad 1140 and stepped spring contact 700. The electrically conductive path provided by the windings associated with the second portion 722 may be, for example, in addition to the electrically conductive path provided by a winding in the transition portion 740.

Figure 12:
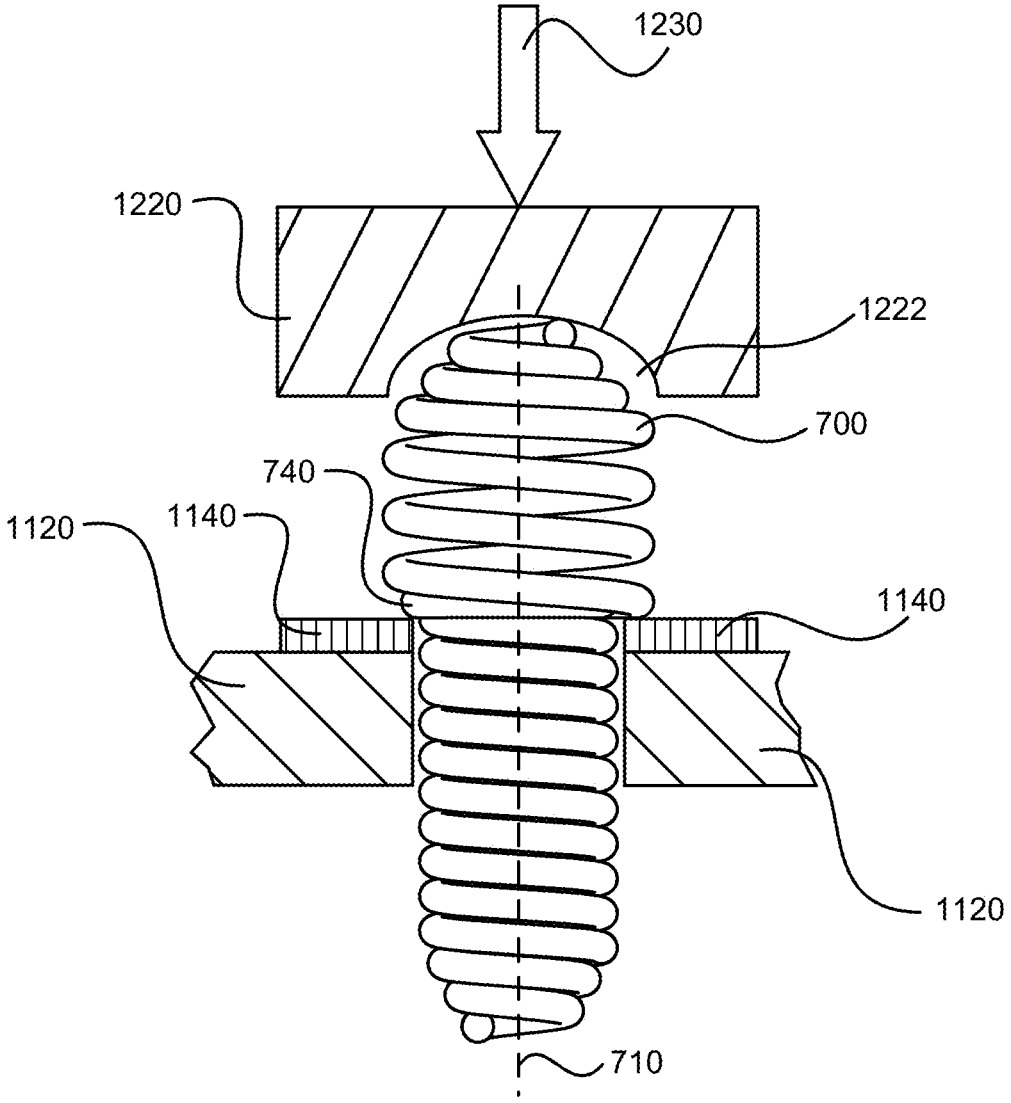
FIG. 12 illustrates an example operation of the stepped spring contact illustrated in FIG. 7.

FIG. 12 illustrates an example operation of stepped spring contact 700. Referring to FIG. 12, a force 1230 (e.g., pressure) may be applied to the stepped spring contact 700 by, for example, a connector terminal 1220. Applying the force 1230 may cause an electrically conductive portion of the connector terminal 1220 to make mechanical contact with the stepped spring contact 700 and form an electrical path between the connector terminal 1220 and the stepped spring contact 700.

Moreover, applying force 1230 may cause one or more active windings associated with the stepped spring contact 700 to compress, thereby, exerting a force on one or more windings in the transition portion 740. The force on the windings in the transition portion 740 may cause a winding in the transition portion 740 to make mechanical contact with pad 1140 and form an electrical path between connector terminal 1220 through stepped spring contact 700 and the winding in the transition portion 740 to pad 1140.

Note that connector terminal 1220 may include a cavity 1222 (e.g., a dimple). The cavity 1222 may be sized to receive a portion of tip 724. The cavity 1222 may act to stabilize stepped spring contact 700 when force 1230 is applied to the stepped spring contact 700 by connector terminal 1220.

Note that stepped spring contact 700, PCB 1120, and connector terminal 1220 may be contained in a device such as, for example, an MSG sensor. It should be noted, however, that stepped spring contact 700 may be used in devices other than an MSG sensor to provide electrical continuity between two points in these devices.

It should also be noted that stepped spring contact 700 may be used to provide electrical continuity between items other than a PCB and a connector terminal. For example, stepped spring contact 700 may be used to provide electrical continuity between two different PCBs that may be contained in a device.

The foregoing description of embodiments is intended to provide illustration and description but is not intended to be exhaustive or to limit the invention to the precise form disclosed. Modifications and variations are possible in light of the above teachings or may be acquired from practice of the invention.

No element, act, or instruction used herein should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

The invention claimed is:

1. A stepped spring contact comprising:

a first portion having a plurality of windings, the plurality of windings including a first active winding portion and a second active winding portion, a pitch associated with windings in the first active winding portion being different than a pitch associated with windings in the second active winding portion;

a second portion having a plurality of windings; and a transition portion, the transition portion having a winding that makes electrical contact with a pad on a printed circuit board (PCB), a diameter of the winding in the transition portion being greater than a diameter of the plurality of windings in the second portion at their widest point.

2. The stepped spring contact of claim 1, wherein a diameter of the plurality of windings in the first portion at their widest point is greater than the diameter of the plurality of windings in the second portion at their widest point.

3. The stepped spring contact of claim 1, wherein the first portion includes a tip.

4. The stepped spring contact of claim 3, wherein the tip makes electrical contact with a terminal connector associated with a device.

5. The stepped spring contact of claim 4, wherein the device is a micro-strain gauge (MSG) device.

6. The stepped spring contact of claim 3, wherein the tip is flat shaped, and wherein a plurality of windings associated with the tip taper towards a center of the stepped spring contact at an angle between 1 and 15 degrees with respect to an axis associated with the center of the stepped spring contact.

7. The stepped spring contact of claim 3, wherein the tip is conical shaped having an envelope angle of tip diameter transition zone with respect to an axis associated with a center of the stepped spring contact of between 10 and 80 degrees.

8. The stepped spring contact of claim 1, wherein the first active portion contains a winding that is associated with a pitch that is greater than pitches associated with windings contained in the second active portion.

9. The stepped spring contact of claim 1, wherein the first portion contains a third active winding portion, and wherein a pitch associated with a winding in the third active portion is greater than pitches associated with windings contained in the second active portion.

10. The stepped spring contact of claim 1, wherein the plurality of windings in the second portion are closely-wound.

11. The stepped spring contact of claim 1, wherein the stepped spring contact is mounted in a plated through-hole contained on the PCB, and wherein the second portion of the stepped spring contact makes electrical contact with the plated through-hole.

12. A stepped spring contact comprising:

a first portion having a plurality of windings, the plurality of windings including a first active winding portion and a second active winding portion, the first active portion containing a winding that is associated with a pitch that is greater than pitches associated with windings contained in the second active portion;

a second portion having a plurality of windings; and a transition portion, the transition portion having a winding that makes electrical contact with a pad on a printed circuit board (PCB), a diameter of the winding in the transition portion being greater than a diameter of the plurality of windings in the second portion at their widest point.

13. The stepped spring contact of claim 12, further comprising:

a tip having a plurality of windings that taper towards a center of the stepped spring contact at an angle between 1 and 15 degrees with respect to an axis associated with the center of the stepped spring contact.

14. The stepped spring contact of claim 12, further comprising:

a tip having an envelope angle of tip diameter transition zone with respect to an axis associated with a center of the stepped spring contact of between 10 and 80 degrees.

15. The stepped spring contact of claim 12, wherein the stepped spring contact is mounted in a plated through-hole contained on the PCB, and wherein the second portion of the stepped spring contact makes electrical contact with the plated through-hole.

16. A stepped spring contact comprising:

a first portion having a plurality of windings, the first portion containing a first active winding portion, a second active winding portion and a third active winding portion, a pitch associated with windings in the first active winding portion being different than a pitch associated with windings in the second active winding portion, and a pitch associated with a winding in the third active winding portion is greater than pitches associated with windings contained in the second active portion;

a second portion having a plurality of windings; and a transition portion, the transition portion having a winding that makes electrical contact with a pad on a printed circuit board (PCB), a diameter of the winding in the transition portion being greater than a diameter of the plurality of windings in the second portion at their widest point.

17. The stepped spring contact of claim 16, further comprising:

a tip having a plurality of windings that taper towards a center of the stepped spring contact at an angle between 1 and 15 degrees with respect to an axis associated with the center of the stepped spring contact.

18. The stepped spring contact of claim 16, further comprising:

a tip having an envelope angle of tip diameter transition zone with respect to an axis associated with a center of the stepped spring contact of between 10 and 80 degrees.

19. The stepped spring contact of claim 16, wherein the stepped spring contact is mounted in a plated through-hole contained on the PCB, and wherein the second portion of the stepped spring contact makes electrical contact with the plated through-hole.

20. The stepped spring contact of claim 16, wherein the first portion includes a first active winding portion and a second active winding portion, and wherein a pitch associated with windings in the first active winding portion is different than a pitch associated with the second active winding portion.

* * * * *